United States Patent [19]

Schefthaler

[11] Patent Number: 4,860,393

[45] Date of Patent: Aug. 29, 1989

[54] CONVERTIBLE CHAIR FOR EITHER SITTING OR LYING

[75] Inventor: Alois Schefthaler, Solching, Fed. Rep. of Germany

[73] Assignee: Himolla Polstermöbelwerk GmbH, Taufkirchen/Vils, Fed. Rep. of Germany

[21] Appl. No.: 141,988

[22] Filed: Jan. 11, 1988

[30] Foreign Application Priority Data

Jan. 9, 1987 [DE] Fed. Rep. of Germany ..... 3700477

[51] Int. Cl.[4] ..... A47C 17/13; A47C 17/04

[52] U.S. Cl. ..... 5/21; 5/14; 5/18 R

[58] Field of Search ..... 5/18 R, 18 B, 19, 20, 5/21, 22, 14

[56] References Cited

U.S. PATENT DOCUMENTS 4,672,696 6/1987 Horenkamp ..... 5/21

FOREIGN PATENT DOCUMENTS 370962 5/1983 Austria .
2212124 7/1973 Fed. Rep. of Germany .
7929296 1/1980 Fed. Rep. of Germany .
3345916 6/1985 Fed. Rep. of Germany .
8509131 6/1985 Fed. Rep. of Germany .

*Primary Examiner*—Alexander Grosz

[57] ABSTRACT

A piece of furniture convertible from a chair to a cot and vice versa comprising connected inner and outer carriages which can telescope out of a frame from a chair position within the frame to a cot position outside the frame and having a head cushion hinged to the inner carriage and guidingly received in a frame guide such that it is movable from a stowed position behind a fixed back cushion when the inner carriage is in the chair position to a cot position when the inner carriage is moved into the cot position thereof. The outer carriage has a cushion carrier frame carrying a fixed cushion and a folding cushion, which carrier frame is connected to the outer carriage by a lever system for adjusting the carrier frame from a lowered position when the carriages are in the chair position to a raised position when the carriages are moved into the cot position. A platform is hinged to the inner carriage at an end thereof close to the head cushion for receiving thereon the folding cushion in the cot position of the carriages, and movable supporting elements connected to the lever system being provided for moving the platform to an essentially horizontal position when the carriages are moved into the cot position, which elements are adapted to support the platform when the lever system is in a dead center or over-center position when the carrier frame is in the raised position.

5 Claims, 7 Drawing Sheets

CONVERTIBLE CHAIR FOR EITHER SITTING OR LYING

BACKGROUND OF THE INVENTION

The invention relates to a convertible chair for sitting and lying, which has a double carriage consisting of an inner carriage and an outer carriage which can telescope out of a frame. Two cushions are laid one on the other in the chair configuration, and one behind the other in the cot configuration, on a platform of the extended inner carriage and supported on the outer carriage, respectively, and a head cushion is provided which at its upper part engages with sliding or rolling means in a curved frame guide and at its bottom part is hinged to the inner carriage, such that the head cushion can be shifted from a stowed position in the chair configuration behind a frame-affixed back cushion to a deployed position in the cot configuration after the two cushions are laid end to end on the extended carriage. The inner carriage is displaceable with its inner end on frame-affixed guides sloping upward toward the front end of the frame. The two carriages are coupled by laterally mounted guide rails and sliding or rolling elements and the outer carriage is provided with a cushion carrier which is adjustable by means of levers between a lowered position associated with the chair configuration and a raised position associated with the cot configuration.

A convertible chair of this kind is disclosed in DE No. 33 45 916 C2. In the chair configuration, the head cushion is contained in a space behind the back which is affixed to the frame. If to convert the chair to a cot the double carriage is drawn forward out of the frame, the head cushion is automatically shifted to the cot configuration on the basis of its guidance on the frame, since its bottom edge is articulated to the inner carriage. The double carriage forming the chair seat consists of an inner carriage guided on the frame and an outer carriage guided on the inner carriage, and the two cushions are situated on it. When the carriage is extended the upper cushion hinged to the bottom cushion can be folded back onto the inner carriage, so that the head cushion and the other two cushions together form a continuous surface on which to lie.

A chair convertible to a chaise-longue is disclosed by DE No. 79 29 296 U1; it includes an outer carriage and a middle carriage which can be telescoped out of a frame, the middle carriage being equipped with a pivotally mounted support plate.

It is the purpose of the invention to design a seat that is convertible for either sitting or lying, of the kind described above, such that the conversion of the seat to a couch as well as the reverse operation can be performed very simply and quickly and virtually without any bothersome exertion, and the hardware providing for the movement between the relatively movable components will assure simplicity of construction combined with high reliability of operation and therefore a long useful life of the overall system.

SUMMARY OF THE INVENTION

Ths purpose is achieved by providing the inner carriage, in the area of its outer end, with bottom wheels; disposing the guide rails on the inner carriage so that they run parallel to the carriage bottom and accommodate the coupling wheels fixedly disposed on the outer carriage and; making the platform, hinged at the frame end to the inner carriage, convertible at its end situated opposite the pivot in the operation of pulling it out, to a horizontal position stabilized by a dead center or overcenter position of the levers by means of supporting elements which are mounted on the levers of the cushion carrier frame of the outer carriage.

An important advantage is that the outer carriage and the inner carriage move relative to one another in only one horizontal plane, which is important to ease of operation.

The division of the inner carriage into a bottom box that can preferably be used as a bedding box and a tilting platform which in the extended position is brought to the horizontal position by a system of levers, has an advantageous effect on the ease of operation of the overall system, but on the other hand offers a desirable freedom of configuration as regards the desired level of the bed surface.

The double employment of the operating levers in the outer carriage as lifting and supporting elements for the platform of the inner carriage leads again to a simplification of the overall construction, and makes it possible for virtually all of the functional hardware to be contained in the outer carriage, which facilitates manufacture and assembly.

DESCRIPTION OF THE DRAWING

The invention will be further explained below with the aid of an embodiment in conjunction with the drawing, wherein.

DESCRIPTION OF A PREFERRED EMBODIMENT

Figure 1:
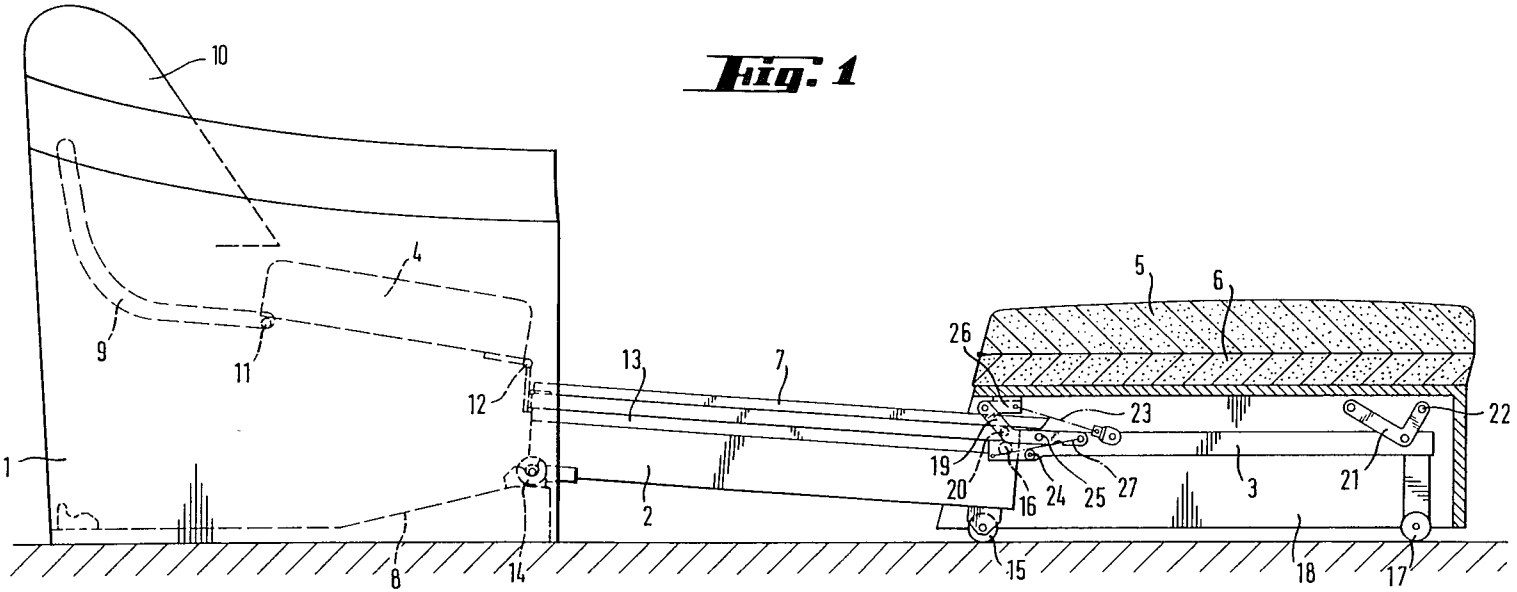
FIG. 1 is a diagrammatic side view of the chair during the operation of converting from a chair to a cot.

FIG. 1 is a diagrammatic representation of a frame 1 of a piece of upholstered furniture which can be used both as a chair and as a cot.

In the chair configuration, the double carriage, shown in FIG. 1 in a fully extended state, is situated between the two side parts of the frame 1, and the head cushion 4, shown in the approximately horizontal position in FIG. 1, is drawn back behind the back cushion 10 which is affixed to the frame.

To convert the chair to a cot, the double carriage is drawn out of the frame 1 by means of a suitably located handle, the double carriage first rolling out on the outer and inner rollers 15 and 14 of the inner carriage 2, while the inner rollers 14 run on a guide 8 on the frame side, which slopes upward toward the front of the frame 1 so that the frame end of the inner carriage 12 is lifted.

The inner rollers 14 are preferably offset rearwardly on the inner carriage 2 in order to make best use of the platform 7 that is part of the inner carriage.

While the dual carriage is being pulled out, the head cushion 4, which at first was behind the back cushion 10 affixed to the frame, is drawn out with the carriage, since this head cushion 4 on the one hand is connected at its bottom end by a hinge 12 to the inner carriage 2 and its upper end bears sliding elements 11 engaged in a curved guide 9 in the frame 1. The head cushion 4 is in this manner converted from the stowed position to a horizontal, in-use configuration.

The inner rollers 14 of the inner carriage 2 lie, in the position shown in FIG. 1, on corresponding abutments of the guide 8. Underneath these abutments are provided detent recesses which are engaged by prolonged axial parts of the outer rollers 15 when the double carriage is in the retracted state, and assure that the double carriage is locked in the chair configuration. This detent can be overcome in order to extend the seat simply by pulling on the double carriage.

In the state shown in FIG. 1, the inner carriage 2 is already in the fully extended position, while the cushion holding frame 18 associated with the outer carriage 3 is still in the lowered position.

The cushion carrier frame 18, which carries preferably a fixed cushion 6 and a folding cushion 5, is connected to the outer carriage 3 by a dual angled lever system which is formed of inner, i.e., frame-end, angled levers 19 and outer, i.e., on the outside end, angled levers 21.

By means of these angled lever systems the cushion carrier frame 18 can be raised up, while the synchronism of the movement of the angled levers 21 provided on both sides of the outer carriage 3 is assured by a torque rod 22 which joins together the outer angled levers 21.

The raising movement is assisted by springs 23 and 27.

The outer carriage 3 has at one end outer rollers 17 and is supported on the inner carriage 2 by coupling wheels 16 engaged in guide rails 13 which are fastened to the inner carriage 2 on the outside of this box-like inner carriage 2.

Figure 2:
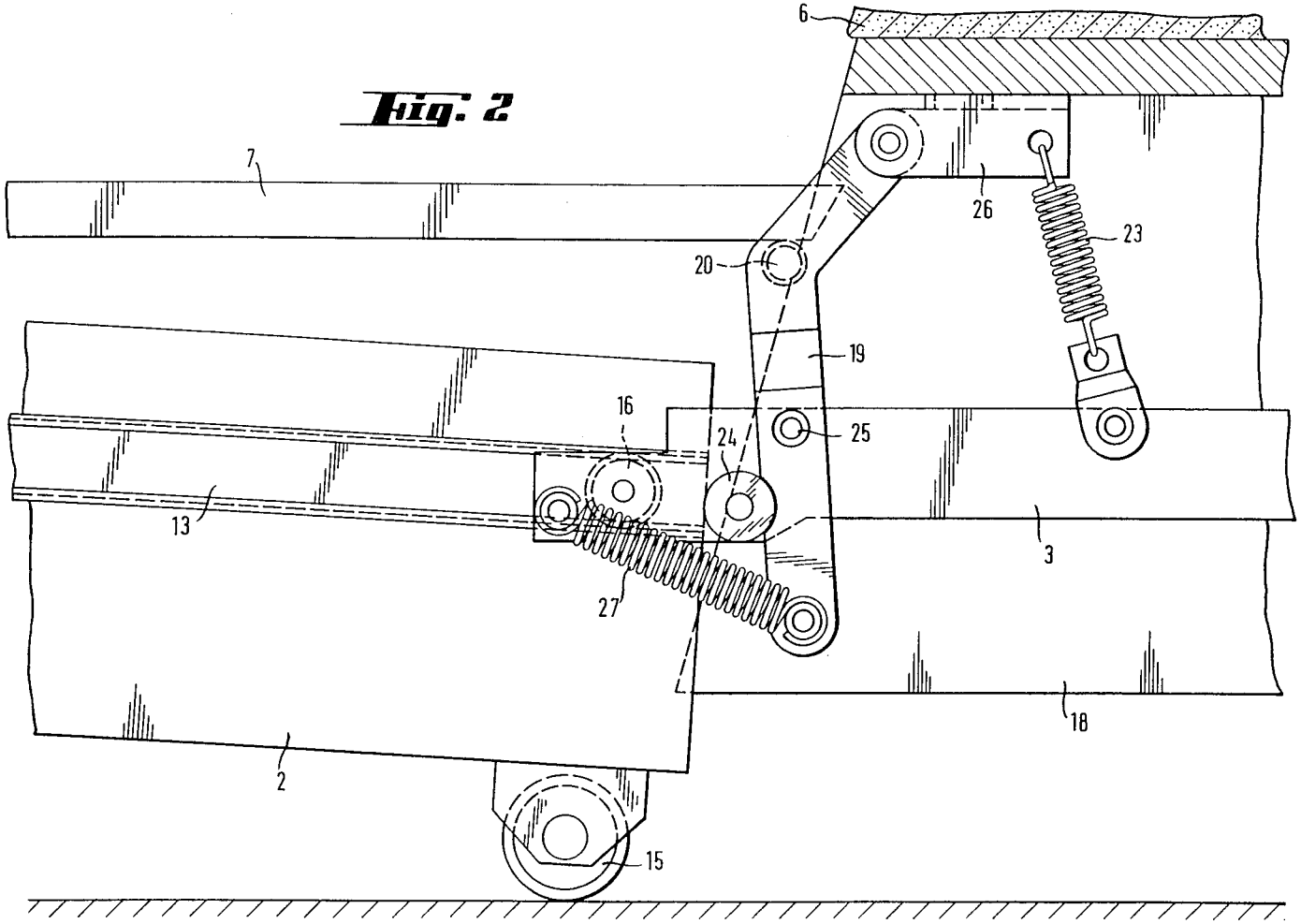
FIG. 2 is a diagrammatic side view of the area of transition between the inner and outer carriage after the reclining position is reached.

When the cushion holder frame 18 is changed over from the lowered position shown in FIG. 1 to the raised position, supporting means 20 provided on the angled levers 19 engage the platform 7 of the inner carriage and swing this platform 7 articulated to the frame end to a horizontal position (FIG. 2). In this horizontal position the platform 7 can then accommodate the folding cushion 5 and a flat bed surface is obtained, consisting of a fixed cushion 6, the folding cushion 5 and the head cushion 4.

FIG. 2 shows the transitional area between the inner carriage 2 and the outer carriage 3 with the cushion carrier frame 18 raised.

It can be seen that the inner carriage 2, on account of the lift at the frame end, assumes a sloping position, while the platform 7 is raised by means of the angled levers 19 and the supporting means 20 fastened to these angled levers 19, and is disposed horizontally and thus parallel to the platform of the cushion carrier frame 18.

The coupling wheels 16 mounted on the outer carriage 3 consisting of a metal frame, are within the lateral guide tracks 13 when in the end position. The angled levers 19, 21 assume in this position a dead-center or over-center position, so that the platform 7 can fully support a load. Moreover, the relative position between the two carriages 2 and 3 will be additionally stabilized after the cushion 5 has been unfolded and is then between the fixed cushion 6 and the head cushion 4.

Figure 3:
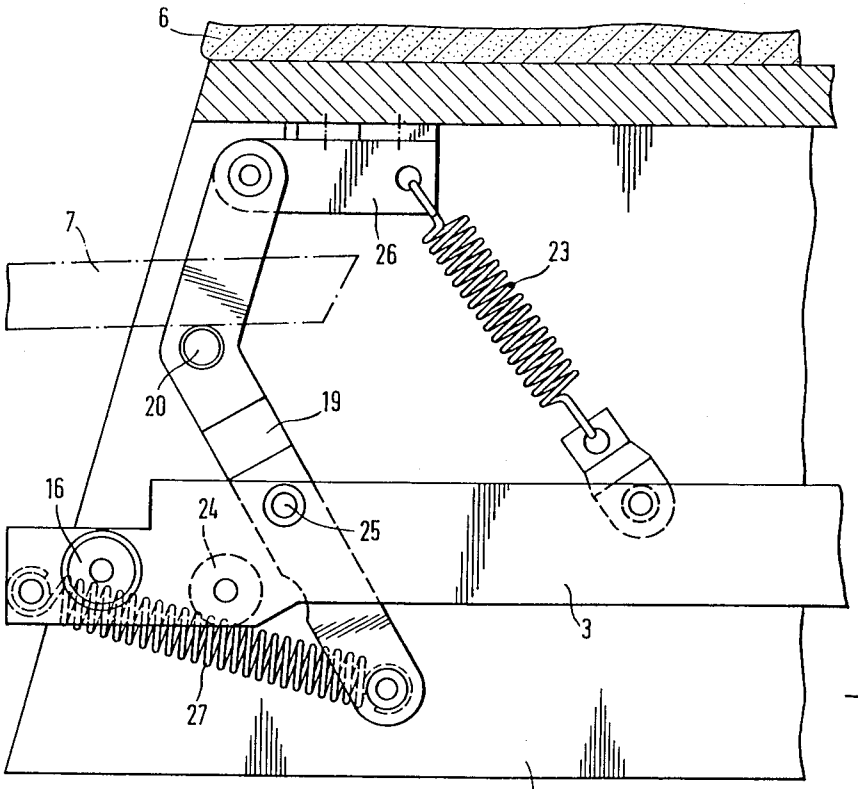
FIG. 3 is a diagrammatic representation of the lever mechanism provided on the outer carriage and cooperating with the inner carriage, just before the raised position is reached.

FIG. 3 shows the inner, i.e., frame-end angled lever 19 just before reaching its raised position. This lever 19 is bent at an obtuse angle and fulcrumed on a pivot 25 in the outer carriage 3. At its free end this lever 19 is articulated to a fitting 26 which is joined to the cushion carrier frame 18. In the area of the bend in the lever 19 there is disposed a supporting means 20 preferably in the form of a roller, which cooperates in the manner already explained with the platform 7 of the inner carriage.

To assist the raising movement a tension spring 23 is provided between the outer carriage 3 and the fitting 26, and preferably still another spring 27 is used which is fastened at one end in the area of the frame end of the outer carriage 3 and at the other end on a projection extended beyond the pivot 25 of the angled lever 19. In the raised position (FIG. 2), the angled lever 19 abuts against a stop 24 affixed to the carriage.

Figure 4:
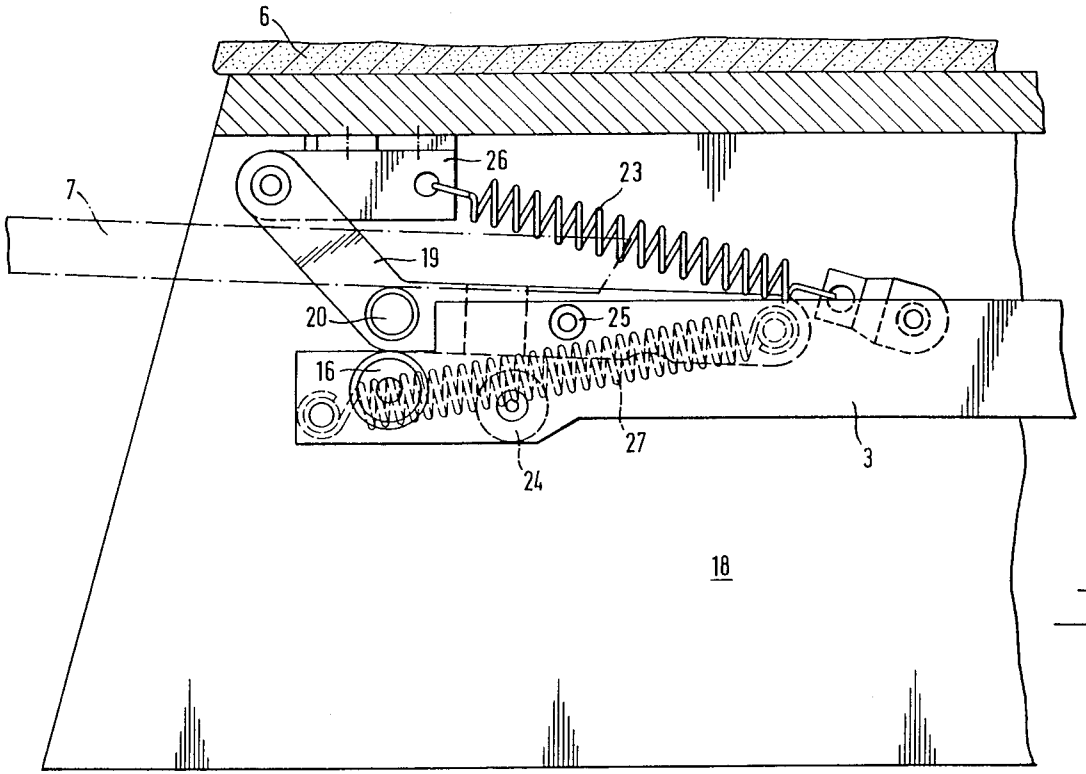
FIG. 4 is a diagrammatic representation of the lever system according to FIG. 3, in the lowered position.
Figure 5:
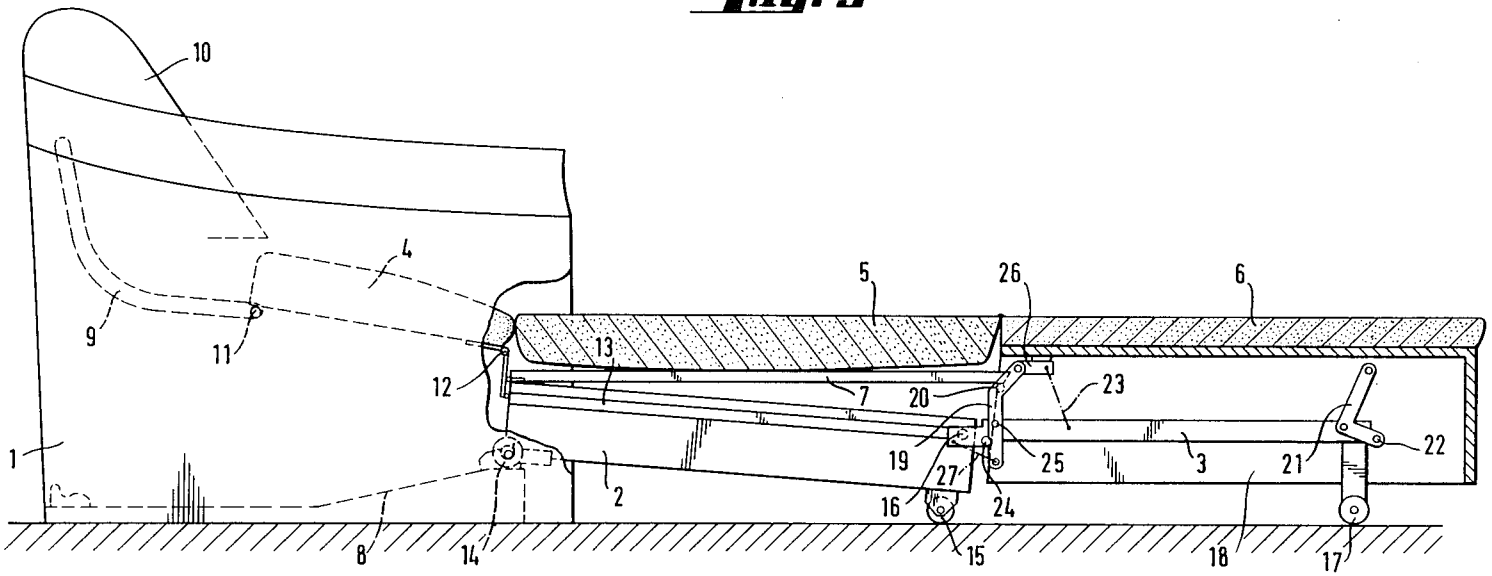
FIG. 5 is a side view, partially in section, of the convertible chair in the fully extended cot position.
Figure 6:
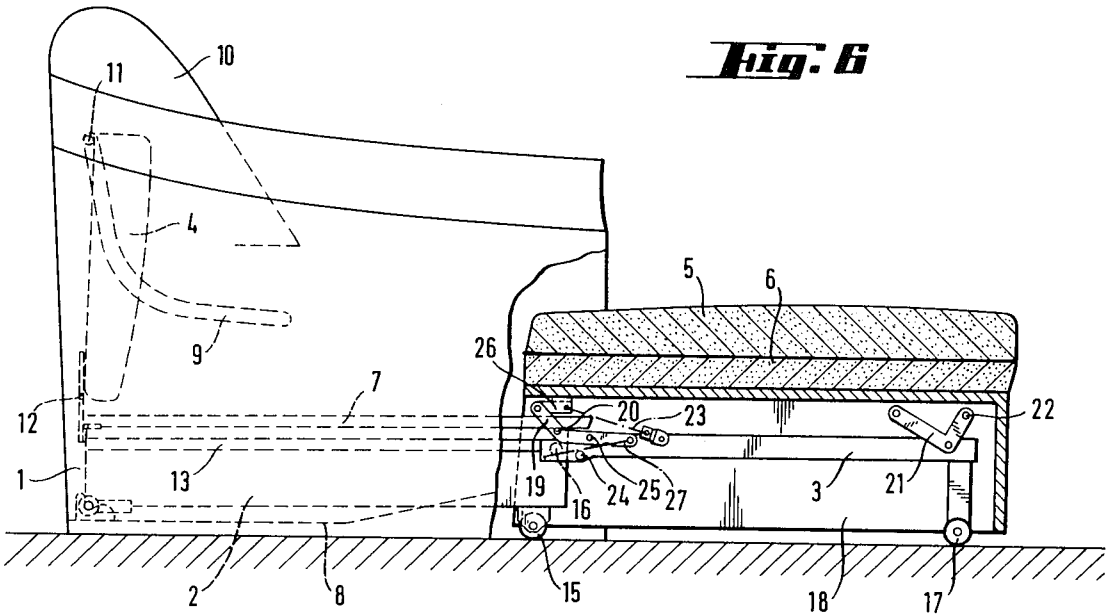
FIG. 6 is a side view, partially in section, of the convertible chair in an intermediate, partially extended position.
Figure 7:
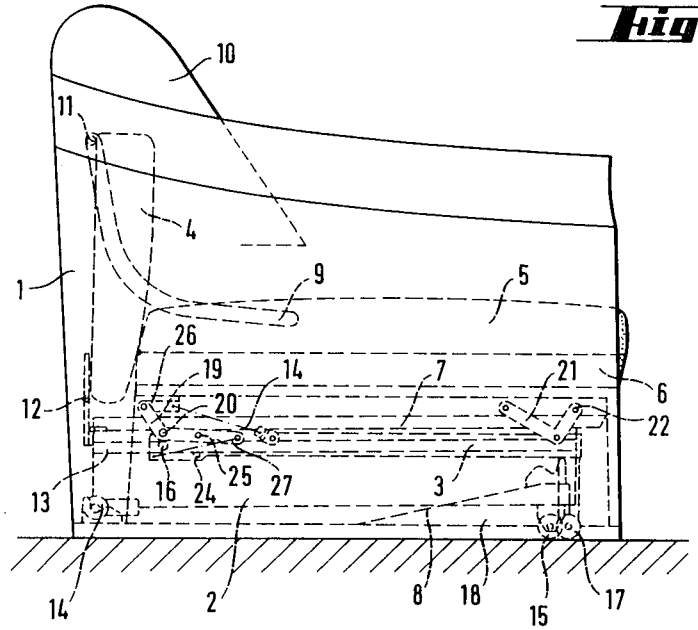
FIG. 7 is a side view of the chair in fully retracted position.

FIG. 4 shows the lever system of FIG. 3 in the lowered position. The two springs 23 and 27 are biased so as to be able to assist in the next raising operation, while the lowering movement is retarded. On account of the configuration of the angled lever 19 and its articulation, the result is a space-saving system that assures virtually noiseless operation.

I claim:

1. A piece of furniture convertible from a chair to a cot, and vice versa, comprising: a frame having a curved frame guide and a fixed back cushion; an inner carriage, and an outer carriage, both movable from a first, chair position within the frame to a second, cot position outside the frame, and vice versa, in said second position the outer carriage being further away from the frame guide than the inner carriage; a head cushion guidingly received in said frame guide and hinged to said inner carriage, the head cushion being movable from a stowed position behind the fixed back cushion when the inner carriage is in said first position, to a cot position when the inner carriage is in said second position, and vice versa; said frame having guides along which said inner carriage is displacable within the frame, wheels connected to said inner carriage remote from said head cushion for rolling along a floor; said outer carriage having a cushion carrier frame, a double cushion on said cushion carrier frame, lever means interposed between said cushion carrier frame and said outer carriage for adjusting the cushion carrier frame from a lowered position when the inner and outer carriages are in said chair position, to a raised position when said inner and outer carriages are in said cot position, and vice versa; means coupling said inner and outer carriages to each other, said coupling means comprising guide rails at said inner carriage and extending essentially parallel to a bottom of the inner carriage, sliding or rolling means connected to said outer carriage and displacable within said guide rails; a platform hinged to said inner carriage at an end thereof close to said head cushion, for receiving thereon one part of the double cushion in the cot position; and means for moving said platform into an essentially horizontal position when said inner and outer carriages are in said the cot position, said moving means including supporting elements connected to said lever means and adapted to support said platform when said lever means is in a dead center or over-center position, when said cushion carrier frame is in said raised position.

2. A piece of furniture according to claim 1, wherein said lever means comprises inner levers on the outer carriage, said inner levers being offset inwardly with regard to said sliding or rolling means, each of said lever means being an angled lever forming an angle pointing toward said cushion carrier frame, said supporting elements being situated respectively at said angle.

3. A piece of furniture according to claim 2, wherein in said lowered position of said cushion carrier frame said supporting elements are situated directly above said sliding or rolling means.

4. A piece of furniture according to claim 1, wherein said lever means includes outer levers, and a torque rod joining said outer levers to each other.

5. A piece of furniture according to claim 1, wherein said inner carriage forms a bedding box.

* * * * *